US005781868A

United States Patent [19]

Miller et al.

[11] Patent Number: 5,781,868

[45] Date of Patent: Jul. 14, 1998

[54] HIGH PRESSURE WASHOUT OF CHEMICAL AGENTS

[75] Inventors: Paul L. Miller, Minnetonka; Heather L. Getty, Plymouth; Millard M. Garrison, Edina, all of Minn.

[73] Assignee: Alliant Techsystems Inc., Hopkins, Minn.

[21] Appl. No.: 728,668

[22] Filed: Oct. 10, 1996

Related U.S. Application Data

[63] Continuation of Ser. No. 365,860, Dec. 29, 1994, abandoned.

[51] Int. Cl.[6] ..... D62D 3/00

[52] U.S. Cl. ..... 588/200

[58] Field of Search ..... 588/200; 264/35, 264/36; 134/24, 5, 22.12, 172, 22.13, 22.14, 22.17, 22.18, 22.19, 33

[56] References Cited

U.S. PATENT DOCUMENTS

| | | | |
|---|---|---|---|
| 1,492,905 | 5/1924 | Swanick | 134/5 |
| 1,492,922 | 5/1924 | Knight | 134/5 |
| 4,018,636 | 4/1977 | O'Neill et al. | 149/19.4 |
| 4,744,517 | 5/1988 | Iwamoto et al. | 239/263 |
| 4,793,866 | 12/1988 | McIntosh | 134/24 |
| 5,052,624 | 10/1991 | Boers et al. | 239/525 |
| 5,167,721 | 12/1992 | McComas et al. | 134/32 |
| 5,370,845 | 12/1994 | Miller et al. | 422/186.3 |

FOREIGN PATENT DOCUMENTS

| | | |
|---|---|---|
| 2 630 667 | 11/1989 | France . |
| 4010757C1 | 4/1990 | Germany . |
| 40 10 757 | 8/1991 | Germany . |
| PCT/US90/02734 | 5/1990 | WIPO . |

OTHER PUBLICATIONS

A.F. Conn & S.L. Rudy, *Conservation and Extraction of Energy with the Cavigjet* in Jet Cutting Technology 19, 28 (Fourth Int'l Symposium on Jet Cutting Technology 1978).

*Primary Examiner*—Ngoclan Mai

*Attorney, Agent, or Firm*—Merchant, Gould, Smith, Edell, Welter & Schmidt, P.A.

[57] ABSTRACT

Described is a method of removing chemical agents from the interior of chemical agent filled bodies such as munitions shells. A rotating nozzle is inserted into an opening cut into the shell. High pressure fluidjets (i.e. from about 1,500 psi to above 40,000 psi) are projected from orifices in the nozzle onto the chemical agent in the shell. Chemical agent and chemical agent laden fluid is contained and carried away from the shell for recycle or disposal.

20 Claims, 3 Drawing Sheets

HIGH PRESSURE WASHOUT OF CHEMICAL AGENTS

This is a continuation of application Ser No. 08/365,860, filed Dec. 29, 1994, now abandoned.

FIELD OF INVENTION

This invention relates to the demilitarization of munitions. More particularly, this invention relates to use of high pressure fluidjet technology for the removal of chemical agents from the interior and exterior surfaces of unused military items such as shells and projectiles.

BACKGROUND

As used in this application, demilitarization means the removal any type of chemical agent laden military item such as a shell, projectile or rocket. There are currently a number of methods disclosed by the prior art that can be used to demilitarize chemical munitions, for example, rinse out and drain out. These methods, however, cannot be used to remove materials which polymerize, solidify or are absorbed into the container pores and crevices.

In the existing systems utilized by the military, the chemical agents are drained or reacted in situ with the neutralizing materials. Some of the chemical agents polymerize to form hard surface "skins" or form a reaction "skin" that is impervious to the reaction of the neutralizing materials. In addition, many of the chemical agents are non-polar in nature and are immiscible in typically aqueous solutions of neutralizing materials which complicate the neutralization of the chemical agents.

Neither rinse-out or drain-out achieve 5× cleanliness required by Army Material Command Regulation 385-61 for chemical weapons.

It was discovered that the washout process produces washed out particles of widely varying size, for example, anywhere from tenths of millimeters to tens of centimeters in diameter. Further, many of the particles can be large enough to clog piping and filtering systems designed to carry away and recycle particle laden washout fluid.

As a result of these drawbacks, there is tremendous room for improvement in the field of pressurized fluid washout of military materials. A system is required which possesses a number of characteristics. First, the system should consume less washout fluid, and produce lower amounts of used washout fluid than other washout methods. Second, the process should be able to achieve 5× cleanliness. Third, an efficient and safe method to reduce the size of particles produced in the washout process should also be provided.

SUMMARY OF INVENTION

As pointed out above, it is generally thought that use of high pressure fluidjets on chemical agents contained in chemical munitions presents a danger of explosive reaction by causing uncontrollable exothermics and by impingement on the explosive burster contained inside. However, experiments of the inventors demonstrate that if both the diameter of the fluidjet stream and type of fluid used are appropriately controlled, minimal danger of reaction with the chemical agent being removed is encountered.

Two factors are primarily responsible for this result. First, the critical impact velocity necessary for explosive initiation varies as the inverse square root of the diameter of the projectile striking the explosive. Thus, as the diameter of the impinging projectile is reduced, the speed at which the projectile can strike the explosive without causing an explosive reaction increases. Second, it has also been determined that a factor known as the acoustic impedance mismatch between the explosive mass and impinging projectile is important in the initiation of an explosive reaction. For example, the acoustic impedance difference between steel/TNT and water/TNT is a factor of about 3.85. This means that steel is far more likely than water (or a water-like fluid) to initiate an explosive reaction in TNT.

The practical importance of all of this is that fluidjets operating at pressures from about 1,500 to 150,000 psi can be safely used in washout of chemical agents providing that the diameter of the washout stream is critically controlled. Empirical studies of the inventors revealed that if water-like fluids are projected through orifices between about 0.001" and about 0.250" in diameter, at pressures above about 40,000 psi, the likelihood of an explosive reaction due to runaway reaction or uncontrollable exotherm in target materials is no greater than that of lower pressure fluidjets. Further, due to the acoustic impedance mismatch factor, some fluids, such as gasoline, can theoretically be used up to about 600,000 psi.

Accordingly, the present invention is an improved method of removing material from un-used military shells using pressurized fluid washout. In one aspect of the invention, there is provided a method by which a translationally mobile, rotating nozzle mounted at the end of a hollow lance projects fluids at pressures from 1,500 to above 40,000 psi through orifices ranging from about 0.001" to about 0.250" in diameter, onto material contained at the interior of an unused munition with the object of removing the material. As the material is washed out from the munition, it is collected in a collection vessel and channeled away from the washout site along with the used washout fluid.

In another aspect of the invention, there is provided a method of reducing the size of material particles removed from the interior of munitions. A particle reduction screen is positioned inside the collection vessel so that the used washout fluid and removed material must pass through the screen before being channeled away from the washout area. The screen is further positioned so that a back-facing, high pressure washout jet impinges washed out material particles against the screen. In this way, washed out particles that are small enough to pass through the screen do so. Particles that are too large are milled by bombardment against the screen until they are small enough to pass through. The size of the screen mesh is dictated by the maximum size of material particles acceptable to the user. The method is effective for a wide range of desired particle sizes; from a hundredths of millimeters to tens of centimeters.

The washout fluid used in the invention is not limited to a specific type. It may be an erosive agent, a solvent agent, or a combination of both. Useable fluids include: aliphatic and aromatic hydrocarbons, such as naphtha and hexane; ketones, such as cyclohexanone and acetone; aromatic hydrocarbons, such as toluene and xylene; alcohols, such as ethanol and butanol; glycols, such as ethylene and propylene glycol; esters, such as ethyl acetate and n-butyl acetate; water; aqueous or non-aqueous mixtures of the above listed chemicals; aqueous or non-aqueous solutions for the neutralization of chemical agents, such as 5% aqueous solutions of alkali or alkaline earth metal hydroxides and/or hypochlorites (e.g. sodium or calcium hydroxide and/or hypochlorite) for use on neutralizing chemical agents, for example, GB ("sarin") nerve agent; gases that are liquified by pressure, such as propane, butane, and carbon dioxide; gases that are liquified by reduced temperature, such as propane, argon, and nitrogen; and liquified solids, such as microcrystalline wax and low temperature eutectic alloys.

As a preferred embodiment in the washout of chemical agents, the washout fluid is water, an alcohol or mixtures thereof. The alcohol is preferably, methanol, ethanol or butanol. The neutralization of chemical agents during the washout employs the above fluids as solvents for aqueous, non-aqueous or water-miscible solutions containing alkali metal hydroxide and/or hypochlorites. Such solutions can vary in strength from about 1–50%, preferably, about 1–10%, most preferably about 5%.

The invented method can also be used on a wide range of chemical agents including: choking agents such as phosgene (carbonyl chloride), and diphosgene (trichloromethylchloroformate); nerve agents such as Tabun (ethyl N, N-dimethylphosphoramidocyanidate), Sarin (isopropyl methyl phosphonofluoridate), VX, and Soman (pinacolyl methyl phosphonofluoridate); blood agents such as hydrogen cyanide, cyanogen chloride, and arsine (arsenic trihydride); vomiting compounds such as diphenylchloroarsine, adamsite (diphenylaminochloroarsine), and diphenylcyanoarsine; blister agents such as HD distilled mustard (bis(2-chloroethyl) sulfide), phosgene oxime (dichloroformoxime), lewisite (dichloro (2-chlorovinyl)), and phenyldichloroarsine; tear producing compounds such as chloroacetophenone, CNC, CNS, and CS (o-chlorobenzylidene malononitrile); and defoliants such as ORANGE, BLUE , and White.

The above lists of washout fluids and chemical agents useable with the present invention are not intended to be complete. They are only representative of the materials that can be used with the present invention.

The present invention has a number of distinct advantages over existing neutralization methods. First, as discussed above, the use of high pressure fluidjets projected through appropriately sized orifices presents no danger of explosive reaction.

Second, the kinetic energy of the high pressure fluid stream is in excess of the shear strength of even polymerized mustard agent. Thus, these types of high shear strength materials may be effectively washed out using the method of the present invention.

Third, as opposed to conventional methods, the process is effective when used on non-polar chemicals as the insoluble particles become emulsified in the neutralization materials.

Fourth, as discussed above, using smaller fluidjet stream diameters high pressure fluidjets can achieve the same results as current rinse-out or in situ reactions while using less fluid. The current invention therefore uses far less fluid and produces far less waste than some lower pressure methods. As stated above, other fluid washout methods can use up to 50 gal./min. of fluid. In contrast, the present invention uses only about 0.5 to about 4 gal./min. of fluid.

Finally, the present invention is capable of cleaning a container of chemical agent materials to a level as good or better than that of the required 5-× cleanliness. The cleanliness achieved can also be stated in terms of mass of residual material per unit area. In these terms, the present invention can achieve a cleanliness level of a maximum of 500 micrograms per square inch. At these levels of contamination, the empty projectile casings meet the requirements of Environmental Protection Agency as being non-hazardous empty containers. None of the existing processes can achieve these results.

Another advantage of the present invention is the use of a chilling means to reduce the temperature of the washout fluid. The washout fluid projected onto the contained material is below the melting point of the material. This ensures that the heat generated by the reaction of the chemical agent during neutralization does not boil the solutions or cause either excess pressure or damage to the system. No interference with washout equipment is experienced and there is no need for further processing of the removed material.

Another advantage of the current invention is that the use of separate pressurized waterjets focused at the washout device removes the accumulation of insoluble chemical agent material. This is accomplished safely and without interfering with either the positioning of the washout device or the simultaneously occurring washout process. It further facilitates free movement of the washout lance through any bushings or guides.

A final advantage of the present invention is that the use of a particle reduction screen reduces the size of removed material particles to whatever diameter is required by the user. This keeps large particles of material from plugging up pumps and plumbing in the processing of removed material. Further, the contained material can be reduced to any size in a manner that is both faster and safer than existing methods. The particle reduction method has the final advantage of not requiring any additional energy or space expenditures; the milling takes place at the site of the washout and uses energy already present in a backfacing fluidjet.

For a better understanding of the invention and advantages of its use, reference should be made to the drawings and accompanying descriptive matter in which there is illustrated and described a preferred embodiment of the invention.

DETAILED DESCRIPTION OF THE INVENTION

Figure 1:
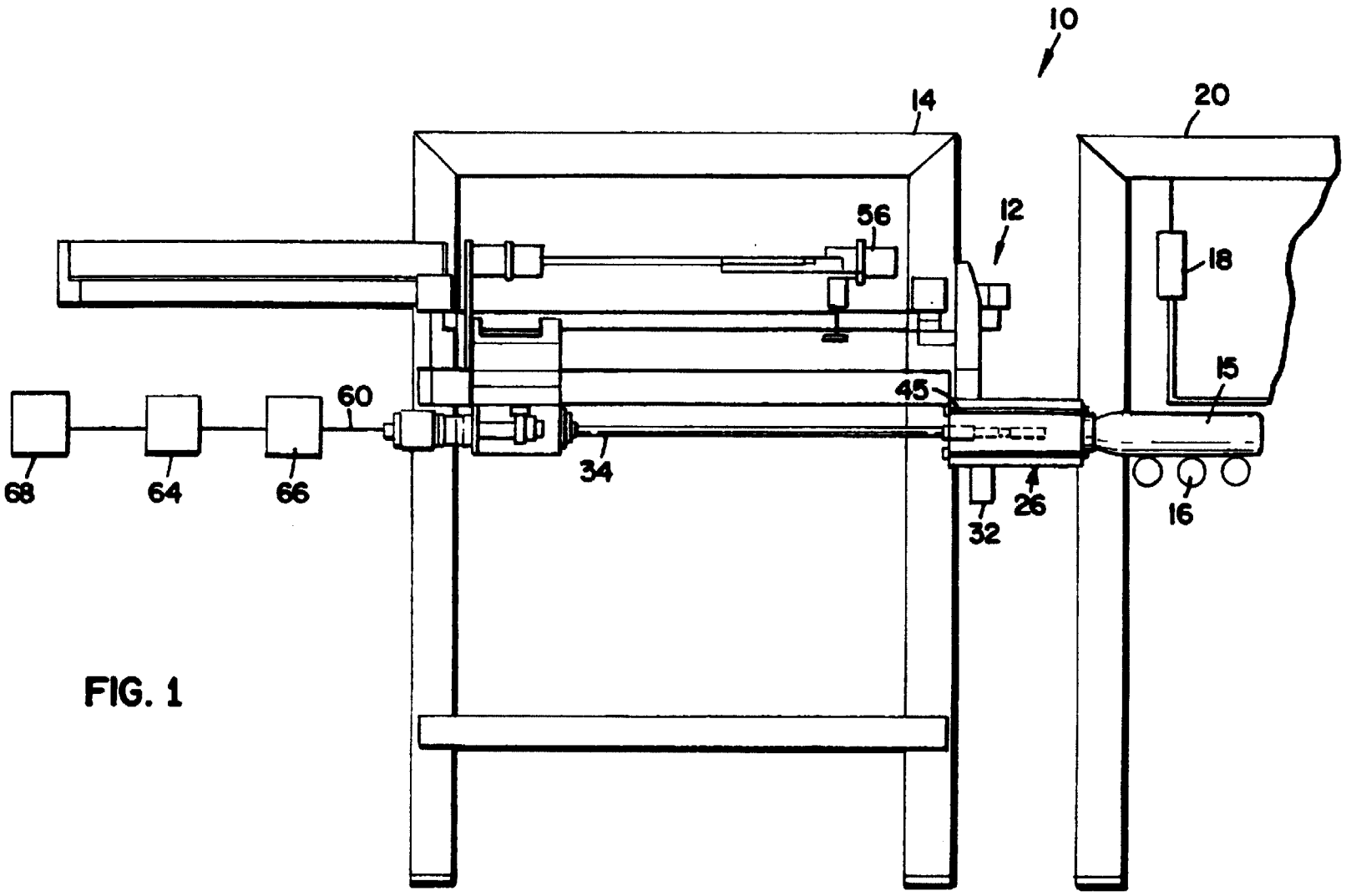
FIG. 1 shows a side view of the washout station.

Referring to FIG. 1, the system for high pressure washout of chemical agents is shown generally at 10. The washout apparatus 12 is supported by a frame 14. The chemical agent filled shell 15 rests on a support 16 and is held in place by a clamp 18. The support 16 and clamp 18 are further supported by a frame 20. Though the present invention can be used with a wide variety of chemical agent filled bodies, tests of the preferred embodiment were run on 105 mm shells.

The collector tee 26 is where washed out material and used washout fluid are collected and channelled away. The collector tee 26 is also where the particle classification screen 30 is located. In the preferred embodiment, the collector tee 26 is primarily a cylinder having an inner diameter of about 5.48", and outer diameter of about 5.73" and a height of about 11.37". The collector tee 26 is constructed of stainless steel. A slurry discharge 32 is located in the lowermost part of the wall of the collector tee 26 to carry washed out chemical agent and used washout fluid away from the washout site.

Figure 2:
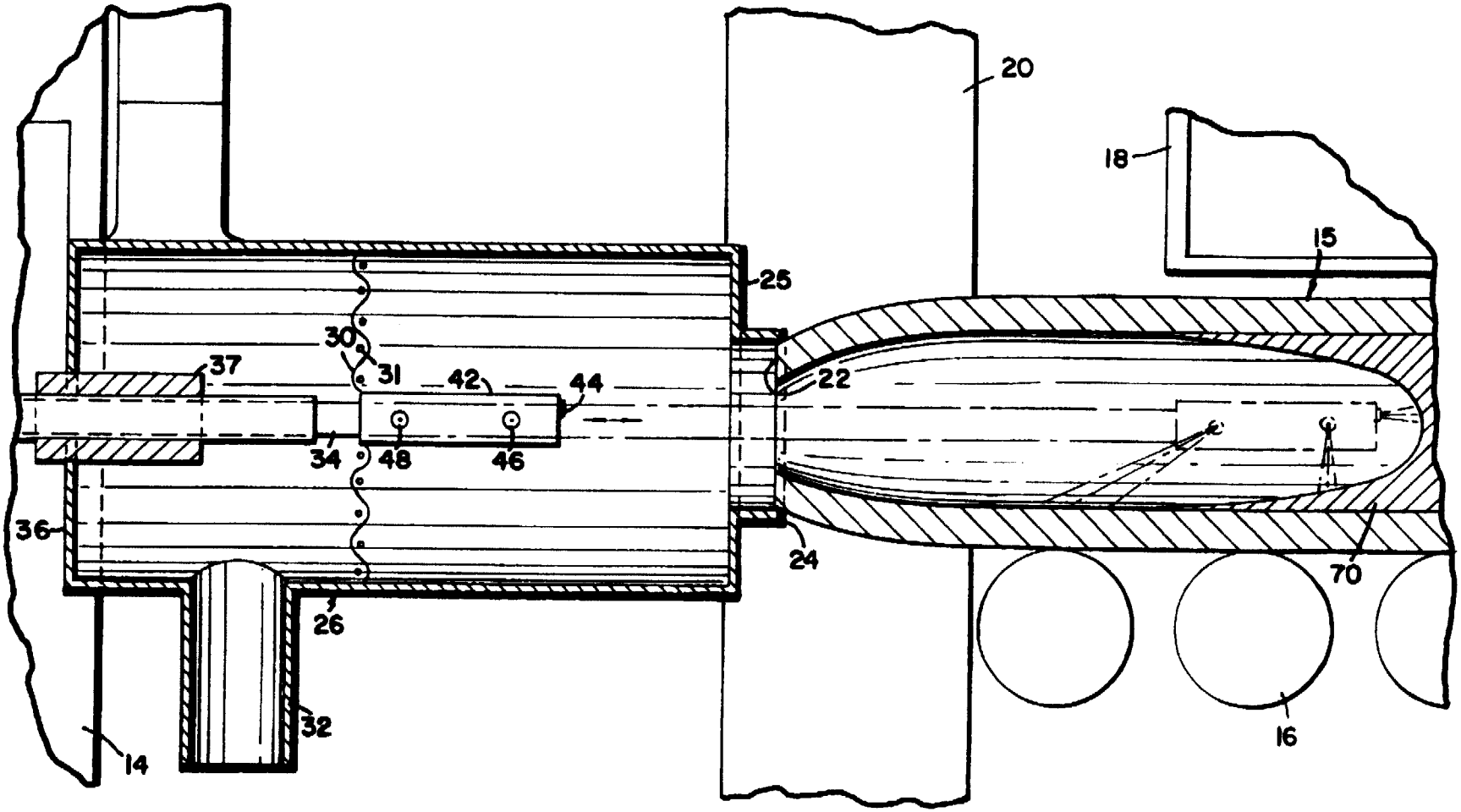
FIG. 2 shows detail of the washout lance, washout nozzle, orifices and high pressure fluid streams.

Referring to FIG. 2, shell 15 is cut open at 22. This opening can be cut using any method of cutting explosive bodies well known in the art, such as abrasive waterjet, or may be made by removing a fuse or fill plug. The clamp 18 applies pressure to the shell 15 to hold it in place. The nose seal 24 applies pressure of the collector tee 26 against shell 15. The opening 24 is a circular flange about 2.86" in diameter. The precise diameter of the flange will depend upon the size shell that is being washed out. The flange extends out about 0.8" from the projectile face 25 of the collector tee 26. No O-ring is used in creating the seal because during the washout process, the interior of the collector tee 26 shell 15 combination will be at lower pressure than the exterior. This vacuum acts to prevent leakage.

The washout lance 34 passes through the lance face 36 (the face opposite the projectile face 25) of the collector tee 26. The lance passes through an opening about 0.9" in diameter in the lance face 36 of the collector tee 26 which is fitted with a bushing 37. Inlets for the fluid supplies 78, 80, 82 for the lance stripper nozzles 72, 74, 76 are located in the uppermost wall of the collector tee 26. The collector tee 26 is mounted to the stand 14. The tie rods through the lance face 36 and the projectile face 25 hold the connector tee together. The connector tee is mounted by a flange on top.

In the preferred embodiment, the washout lance 34 is a 3' long, 9/16" piece of high pressure tubing. The washout nozzle 42 is threaded onto the collector tee end of the washout lance 34 and is located inside the collector tee 26. Referring to FIG. 2, three orifices 44, 46, 48, are threaded into the washout nozzle. The orifices 44, 46, 48, can range in diameter from 0.001" to 0.250". In the preferred embodiment, orifice 44, which emits the "pilot" stream, is 0.010" in diameter; orifice 46, which emits the "side" stream, is 0.008" in diameter; and orifice 48, which emits the back stream is 0.006" in diameter. FIG. 2 also shows the directions of the three streams. The orifices are available from commercial suppliers. Those used in the preferred embodiment are fabricated from sapphire or diamond.

The washout lance 34 can remain rotationally stationary or, be rotated anywhere from about 1 to about 700 rpm. Preferably in the range from about 400 to about 600 rpm. The washout lance 34, washout nozzle 42 and orifices 44, 46, 48, can also be moved translationally so that the washout nozzle 42 and orifices 44, 46, 48, move in and out of the shell 15 being washed out. The washout lance 34 and washout nozzle 42 may be moved in and out of the shell 15 at a rate of more than 0 to about 20 inches per minute. In the preferred embodiment, there is no set rate at which the washout lance 34 and washout nozzle 42 are translationally moved. Mechanisms to both rotate and translationally move the washout lance 34 are well known to those skilled in the art.

Figure 3:
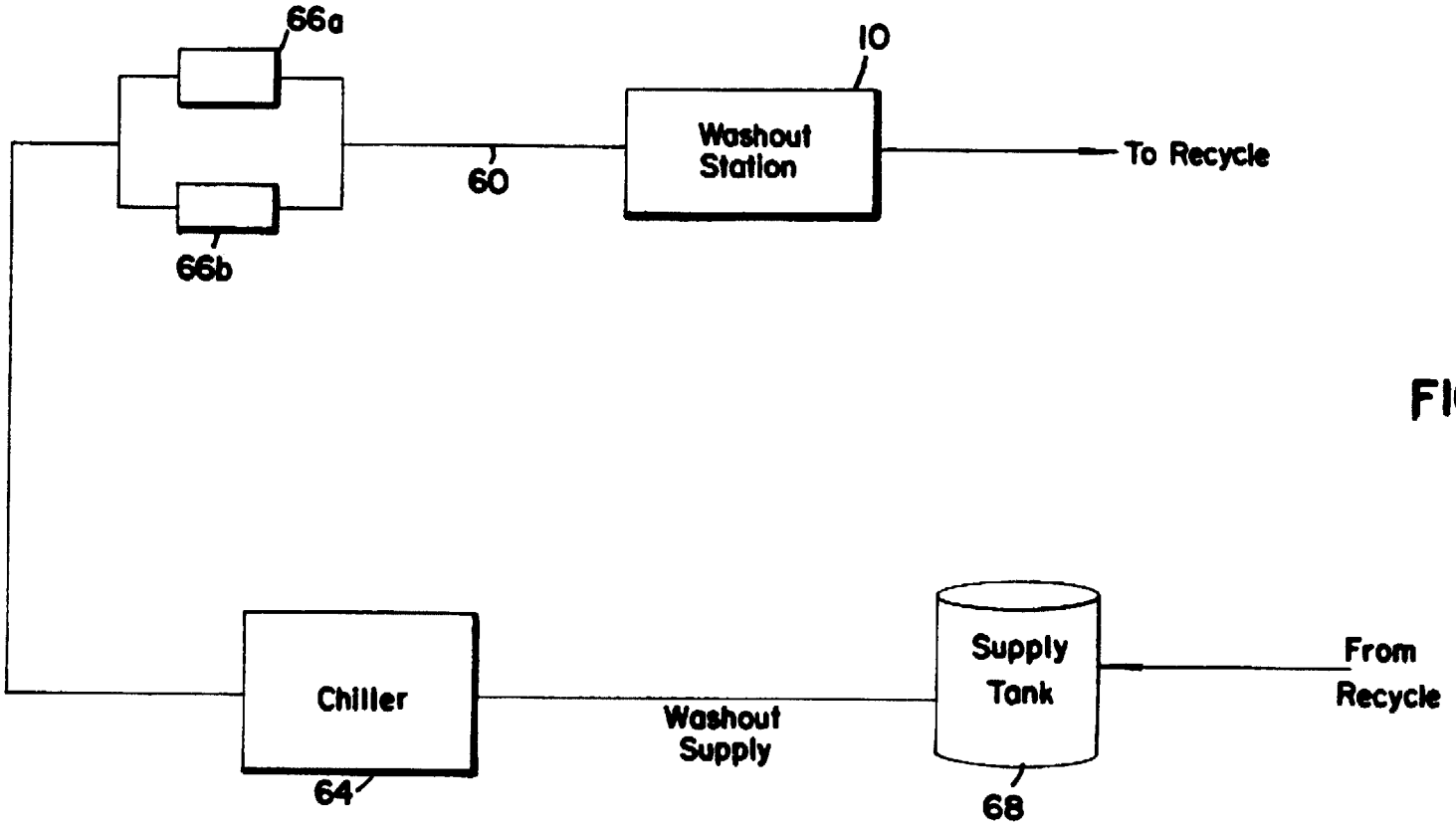
FIG. 3 shows a block diagram of the fluid supply, chiller, intensifier pump and washout station.

The washout fluid is supplied to the washout lance 34 via washout fluid supply pipe 60. Referring to FIG. 3, before being supplied to the washout lance 34, the washout fluid is channeled through a commercial chiller 64 and two parallel commercial intensifier pumps 66*a*, 66*b*. In the preferred embodiment, the intensifier pumps 66*a*, 66*b* are an Ingersoll Rand 50 h.p. streamline II units that pressurize the washout fluid from about 40,000 to about 45,000 psi. The chiller 64 is a FILTRINE model PCP-200A-27, 2 HP compressor, 2 HP pump. The chiller 64 can chill both water and other washout fluids. The temperature of the washout fluid emitting from the chiller 64 is from about 50 to about 55 degrees fahrenheit. In the preferred embodiment, the washout fluid is channeled first through the chiller 64 and then the intensifier pumps 66*a*, 66*b*. However, the present invention may also be effected by channeling the washout fluid first through the intensifier pumps 66*a*, 66*b* and then the chiller 64. The original washout fluid supply 68 is a surge tank in which washout fluid recycled by an explosive laden water recycle process is being pumped.

Referring to FIG. 2 the particle reduction screen 30 is fixed into the collector tee behind the washout nozzle 42 but forward of the slurry discharge 32. The screen 30 is constructed by drilling 24, 0.125" holes 31 evenly spaced around the perimeter of the collector tee 26. Wire is then threaded through the holes so as to create a mesh. The holes are sealed with silicon and clamped with a pipe clamp (not shown). So placed, washout fluid and washed out material must pass through the screen to be further processed. In the preferred embodiment, the mesh in the particle classification screen 30 is about 0.5" in diameter. Thus, washed out particles having a diameter smaller than 0.5" pass through the screen 30 while particles having a larger diameter do not. Washout fluid emitting from the back stream orifice 48 causes washed out material particles not passing through the screen 30 to be bombarded into the screen 30. This bombardment reduces the size of the particles until they are able to pass through the holes in the particle classification screen 30. Thus, no particles greater than 0.5" in diameter pass out of the washout station. Further, the bombardment of the back stream eventually reduces all the material removed from the shell 15 to a size able to pass through the screen 30; no removed material is left in the collector tee 26 or shell 15. Finally, no additional energy is spent in reducing the particle sizes of the removed material.

EXAMPLES

Example: Mustard agent simulant was washed out of a 105 mm projectile. The front of the washout nozzle was placed at a starting point 5" from the projectile mouth. The washout nozzle was advanced at a rate of 4"/min. and stopped at a distance of 1.5" from the projectile inside bottom. The nominal washout water pressure used was 42,000 psi. The washout nozzle was rotated at 400 RPM. The washout process used 0.88 gallons per minute of water. The water was cooled to 47 degrees fahrenheit before entering the intensifier pump. The diameters of the orifices used were as follows: pilot stream, 0.010"; side stream, 0.008"; back stream, 0.006". The results were a shell interior and washout lance that were entirely clean.

Though numerous characteristics and advantages of the invention have been set forth in the foregoing description, together with the details of the structure and function of the invention, the disclosure is illustrative only. Changes may be made in detail, especially in matters of shape, size, arrangement of parts and ranges of variable parameters, within the principles of the invention, to the full extent indicated by the broad, general meaning of the appended claims.

We claim:

1. A method for the removal of chemical agents from chemical munitions comprising:

(a) supplying fluid from a fluid supply means;

(b) pressurizing the fluid to high pressures using a pressurizing means which pressurizes the fluid from about 1,500 psi to about 45,000 psi;

(c) projecting the fluid onto the chemical agent contained in a chemical munition using a directing means inserted or withdrawn at a rate of more than 0 to about 200 inches/minute whereby the chemical agent is removed from the interior of the body of the chemical munition;

the directing means having a hollow lance, a nozzle and a plurality of orifices through which the fluid is projected, each of the plurality of orifices having a diameter in the range of about 0.001" to about 0.250".

2. The method of claim 1 wherein the fluid comprising at least one selected from the group consisting of: aliphatic and aromatic hydrocarbons, ketones, alcohols, glycols, esters, water and mixtures thereof, aqueous and non-aqueous solutions of neutralizing agents for the neutralization of chemical agents.

3. The method of claim 2 wherein the fluid is water, an alcohol, an aqueous or alcoholic solution of an alkali metal hydroxide or hypochlorite, or mixtures thereof.

4. The method of claim 1 comprising the additional step of inserting the directing means into the body of the chemical munition along a rotational axis of symmetry of the body, and rotating either the directing means or the body about the rotational axis of symmetry along which the directing means is inserted.

5. The method of claim 4 wherein either the body or the directing means is rotated at a rate of about 50 to about 10,000 rpm.

6. The method of claim 2 comprising the additional step of chilling the fluid by use of a chilling means to at least below the heat of reaction of the neutralizing agent and chemical agent contained in the body.

7. The method of claim 1 comprising the additional steps of collecting and channeling away washed out chemical agent and used washout fluid using a fluid collection means having an enclosure to contain and collect used washout fluid and removed chemical agent, an inlet to allow used washout fluid and removed chemical agent to enter the enclosure, and an outlet to allow used washout fluid and removed chemical agent to be channeled away from the washout area.

8. The method of claim 7 comprising the additional step of reducing the size of particles of removed chemical agent using a particle reduction screen located at the interior of the fluid collection means;

the stream of fluid passing through an orifice causing removed chemical agent to impact the particle reduction screen such that removed chemical agent particles smaller than the openings in the screen pass through the screen, and removed chemical agent particles larger than the openings in the screen are reduced in size until the particles are small enough to pass though the screen or are emulsified.

9. A method for the removal of chemical agent from chemical agent filled bodies comprising:

(a) supplying fluid from a fluid supply means;

(b) pressurizing the fluid to high pressures using a pressurizing means which pressurizes the fluid from about 1,500 psi to about 45,000 psi;

(c) chilling the fluid by use of a chilling means to a temperature at least below the melting point of the chemical agent to be removed;

(d) inserting a directing means into the chemical agent filled body along a rotational axis of symmetry of the body;

(e) rotating either the directing means or the body about the rotational axis of symmetry of the body along which the directing means was inserted; and (f) projecting the fluid onto the chemical agent contained in the chemical agent filled body using the directing means whereby the chemical agent is removed from the interior of the body;

the directing means having a plurality of orifices through which the fluid is projected, each of the plurality of orifices having a diameter in the range of about 0.001" to about 0.250".

10. The method of claim 7 wherein the fluid comprising at least one selected from the group consisting of: aliphatic and aromatic hydrocarbons, ketones, alcohols, glycols, esters, water and mixtures thereof, aqueous and non-aqueous solutions of neutralizing agents for the neutralization of chemical agents.

11. The method of claim 10 wherein the fluid is water, an alcohol, an aqueous or alcoholic solution of an alkali metal hydroxide or hypochlorite, or mixtures thereof.

12. The method of claim 9 wherein the directing means is inserted or withdrawn from the chemical agent filled body at a rate of more than 0 to 200 inches/minute.

13. The method of claim 9 wherein the rotating of either the chemical agent filled body or the directing means is at a rate of about 50 to about 10,000 rpm.

14. The method of claim 9 further comprising the additional steps of collecting and channeling away removed chemical agent and used washout fluid using a fluid collection means having an enclosure to contain and collect used washout fluid and removed chemical agent, an inlet to allow used washout fluid and removed chemical agent to enter the enclosure, and an outlet to allow used washout fluid and removed chemical agent to be channeled away from the washout area.

15. The method of claim 9 comprising the additional step of reducing the size of removed chemical agent particles using a particle reduction screen located at the interior of the fluid collection means;

the stream of fluid passing through an orifice causing removed chemical agent to impact the particle reduction screen such that removed chemical agent particles smaller than the openings in the screen pass through the screen, and particles larger than the openings in the screen are reduced in size until the particles are small enough to pass though the screen or are emulsified.

16. A method for the removal of chemical agent from chemical agent filled bodies comprising:

(a) supplying fluid from a fluid supply means;

(b) pressurizing the fluid to high pressures using a pressurizing means which pressurizes the fluid from about 1,500 psi to about 45,000 psi;

(c) chilling the fluid by use of a chilling means to a temperature below the heat of reaction of a neutralizing agent and the chemical agent to be removed;

(d) inserting a directing means into the chemical agent filled body along a rotational axis of symmetry of the body;

(e) rotating either the directing means or the body about the rotational axis of symmetry of the body along which the directing means is inserted, the directing means comprised of a hollow lance, nozzle and a plurality of orifices, the nozzle being attached to one end of the hollow lance such that fluid passing through the interior of the hollow lance may pass into the interior of the nozzle, the nozzle having an end face and sides into which the orifices are fixed, such that the fluid at the interior of the nozzle may pass through the orifices to the exterior of the nozzle, each of the plurality of orifices having a diameter from about 0.001" to about 0.250";

(f) projecting the fluid onto the chemical agent contained in the chemical agent filled body using the directing means whereby the chemical agent is removed from the interior of the body, (g) collecting and channeling away removed chemical agent and fluid using a fluid collection means having an enclosure to contain and collect used washout fluid and removed chemical agent, an inlet to allow used washout fluid and removed chemical agent to enter the enclosure, and an outlet to allow used washout fluid and removed chemical agent to be channeled away from the washout area; and (h) reducing the size of particles of removed chemical agent using a particle reduction screen located at the interior of the fluid collection means;

the stream of fluid passing through one or more of the plurality of orifices causing removed chemical agent to impact the particle reduction screen such that particles smaller than the openings in the screen pass through the screen, and removed particles larger than the openings in the screen are reduced in size until the particles are small enough to pass though the screen or are emulsified.

17. The method of claim 16 wherein the fluid comprises: alcohols, water and mixtures thereof, or aqueous and alcoholic solutions of neutralizing agents for the neutralization of chemical agents.

18. The method of claim 17 wherein the fluid is methanol, ethanol, butanol, water, an alkali metal hydroxide or hypochlorite solution thereof, or mixtures thereof.

19. The method of claim 16 wherein the directing means is inserted or withdrawn from the chemical agent filled body at a rate of more than 0 to about 200 inches/minute.

20. The method of claim 16 wherein the rotating of either the chemical agent filled body or the directing means is at a rate of about 50 to about 10,000 rpm.

* * * * *